United States Patent [19]

Powell

[11] 4,035,806

[45] July 12, 1977

[54] ANTENNA MOUNTING BRACKET FOLDABLE INTO AUTOMOBILE TRUNK

[76] Inventor: Truman W. Powell, P.O. Box 535, Zephryhills, Fla. 33599

[21] Appl. No.: 717,321

[22] Filed: Aug. 24, 1976

[51] Int. Cl.[2] ..... H01Q 1/32

[52] U.S. Cl. ..... 343/715; 248/539

[58] Field of Search ..... 343/715, 881, 882; 248/539

[56] References Cited

U.S. PATENT DOCUMENTS 3,984,076 10/1976 Van Ordt ..... 343/715

*Primary Examiner*—Eli Lieberman

*Attorney, Agent, or Firm*—Imirie and Smiley

[57] ABSTRACT

A bracket for mounting an antenna on a vehicle, having an opening giving access to the interior of the vehicle and a closure member for closing the opening, has a base for attachment to the inside of the vehicle adjacent the opening and an antenna support member pivotally connected to the base for folding between an exposed position extending through the vehicle opening to support an antenna for use outside the vehicle, and a storage position inside the vehicle to conceal a supported antenna when not in use.

7 Claims, 4 Drawing Figures

ANTENNA MOUNTING BRACKET FOLDABLE INTO AUTOMOBILE TRUNK

BACKGROUND OF THE INVENTION

1. Field of the Invention

The present invention relates generally to antenna brackets, and more particularly, to an antenna mounting bracket supporting an antenna on a vehicle for folding between an exposed position outside the vehicle and a stored position where the antenna is concealed inside the vehicle.

2. Description of the Prior Art

Vehicle mounted antennas are continually subjected to vandalism and theft, and more recently with the advent of popular Citizens Band radio use, provide a target for those unscrupulous individuals who seek to steal Citizens Band radio equipment for their own use or for sale to others. This problem is particularly serious in public parking lots where a potential thief need only scan the area, locate the antenna, and immediately set out to accomplish his intended task.

In an effort to solve the above problems, conventional antennas have almost universally been replaced by thin wires directly imbedded in the vehicle windshield. These antennas have proven to be satisfactory for conventional AM/FM use; however, their electromagnetic properties do not render them particularly well suited for use in conjunction with Citizens Band radio equipment.

To reduce the number of Citizens Band radio thefts, direct approaches have been taken to lock or permanently attach the radios to the vehicle. In addition, indirect approaches have been taken providing for removable antennas and magnetically mounted antennas which can be disassembled or removed from the vehicle whenever it is parked in an exposed area. All of these techniques exhibit serious disadvantages in that the mounting hardware is either complex and costly or requires constant assembly and disassembly. The removable or disconnectable antenna assemblies also suffer from the disadvantage that they must be stored somewhere when they are taken from the vehicle and, thus, often interfere with the unhampered use of the vehicle trunk.

SUMMARY OF THE INVENTION

It is, therefore, an object of the present invention to support an antenna on a vehicle during periods of use and to conceal the antenna and mount within the vehicle during periods of non-use.

The present invention has a further object in the pivotal attachment of an antenna to a vehicle closure member so as to allow the antenna to be pivotted from an operative position outside the vehicle to a concealed, storage position within the vehicle.

Another object of this invention is to reduce Citizens Band radio theft by facilitating the selective concealment of the antenna during periods when the vehicle is left unattended.

The present invention is summarized as a bracket for mounting an antenna on a vehicle including a closure member for closing an opening providing access to the interior of the vehicle, including a base for attachment to the inside of the vehicle adjacent the opening, and an antenna support movably connected to the base for folding between an exposed position extending through the vehicle opening to support an antenna for use outside the vehicle, and a storage position inside the vehicle to conceal a supported antenna when not in use.

A number of significant advantages are provided by the present invention. Among those are simplicity of design and manufacture, low cost, reliable and convenient use, firm support of an antenna in its operative position and convenient storage of the antenna concealed from view within the vehicle when not in use, and storage of an antenna in a convenient place so as not to detract from the convenient use of all other features of the vehicle.

Other objects and advantages of the present invention will become apparent from the following description of the preferred embodiment when taken in conjunction with the accompanying drawing.

DESCRIPTION OF THE PREFERRED EMBODIMENT

Figure 1:
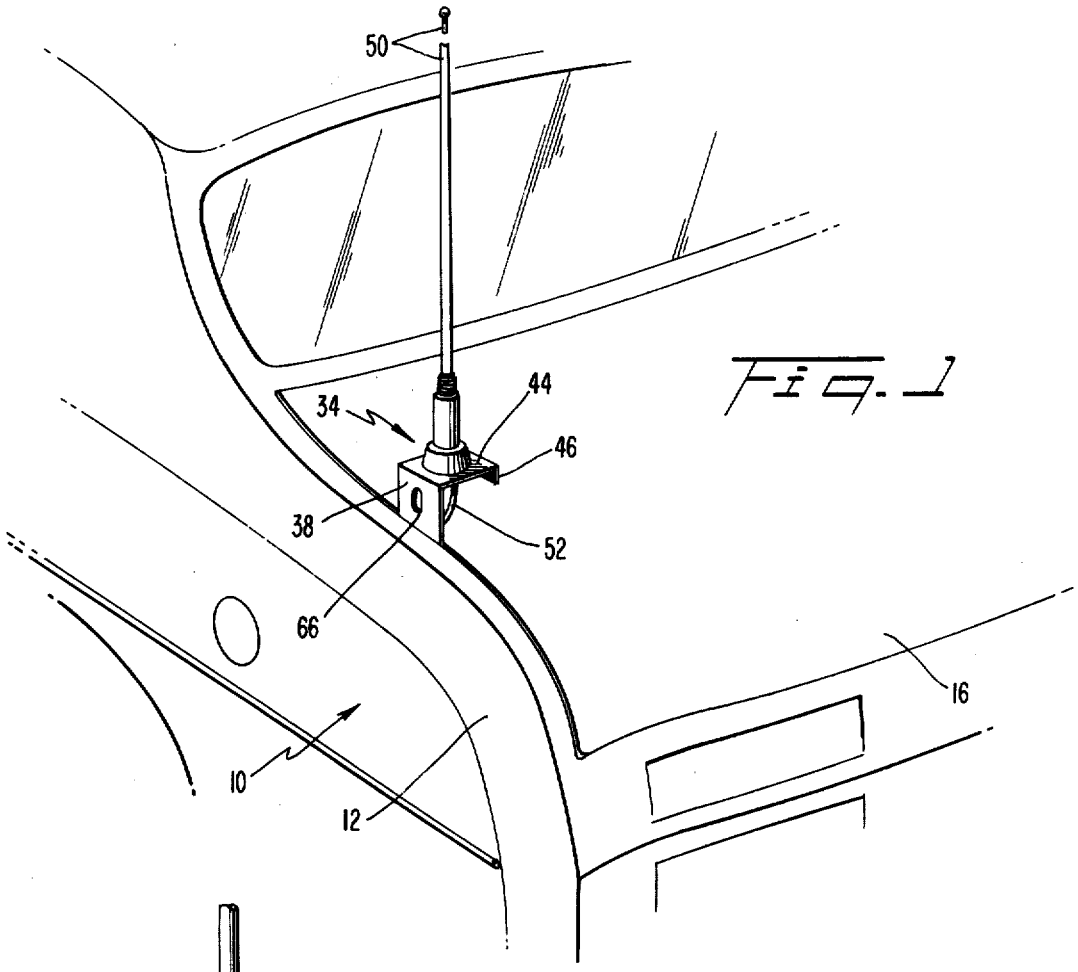
FIG. 1 is a partial perspective view of a preferred embodiment of an antenna mounting bracket according to the present invention in an operative position associated with a vehicle trunk.

As shown in FIG. 1, the present invention is embodied in a vehicle 10 which may be of any suitable type such as a truck, a van, or, as illustrated, a passenger automobile. Vehicle 10 has body 12 defining a plurality of openings such as opening 14 defining the perimeter of a trunk. A lid 16 having integral support ribs 18 is attached, as by hinges, to the body 12 for cooperation with opening 14 so as to facilitate access to the interior of the vehicle, namely the trunk. A gutter 20 has a lip 22 and a rubber seal 24 running about opening 14 to prevent water from entering the trunk.

It should be appreciated, at this point, that the foregoing description relating to the trunk construction is provided merely for exemplary purpose; the hood, doors, and other closure members including similar structure functioning in substantially the same manner. all of these various closures and assemblies are suitable for attachment of the antenna mounting bracket according to the present invention, although the same is particularly well suited for mounting on a vehicle trunk lid. Accordingly, the present description is directed to an application of the present invention to a vehicle trunk only for purposes of brevity, it being intended that the bracket may be used in any suitable position in association with any of the various closure members provided on a vehicle.

The antenna mounting bracket according to the present invention includes a base 26 having a generally flat attachment plate 28 and an angularly offset arm 30 which is connected to the plate 28 at a fold 32. Preferably, base 26 is constructed from a single, generally rectangular, flat sheet of metal bent at fold 32 to form the attachment plate 28 and the arm 30.

An antenna support member 34 is also preferably constructed from a generally rectangular, flat sheet of metal which is bent in a generally S-shape and includes a first support portion 36 and a substantially parallel second support portion 38 joined together by a third support portion 40 which is disposed at approximately a 90° angle to each of the support portions 36 and 38. A V-shaped fold 42 is provided in the third support portion 40 to enable the lateral offset between first and second support portions 36 and 38 to be readily adjusted. A fourth support portion 44 extends horizontally from the upper end of support portion 38 and may be provided with a downwardly extending flange 46, if desired. A hole 48 is defined in support portion 44, and an antenna 50 is fixedly secured to portion 44 through hole 48. Antenna 50 may be of any suitable construction and, for example, may include an attached loading coil to keep the actual length of the antenna small while electrically increasing its effective length in known manner. A cable 52 extends from antenna 50 and may be fed through opening 14 for attachment to radio equipment mounted elsewhere within the vehicle.

It can be appreciated that the dimension of support member 40 and fold 42 is such that a lateral offset is provided between upstanding supports 36 and 38. This offset is necessary to accommodate the width of gutter 20, lip 22, and seal 24 without interference with the normal operation of the trunk lid 16.

A hinge 54 pivotally attaches base 26 and antenna support 34 at the adjacent ends of arm 30 and support portion 36. In this manner, the antenna support 34 may be pivotally rotated from its exposed or operative position shown in FIG. 2 to a concealed or stored position as shown in FIG. 3.

Figure 3:
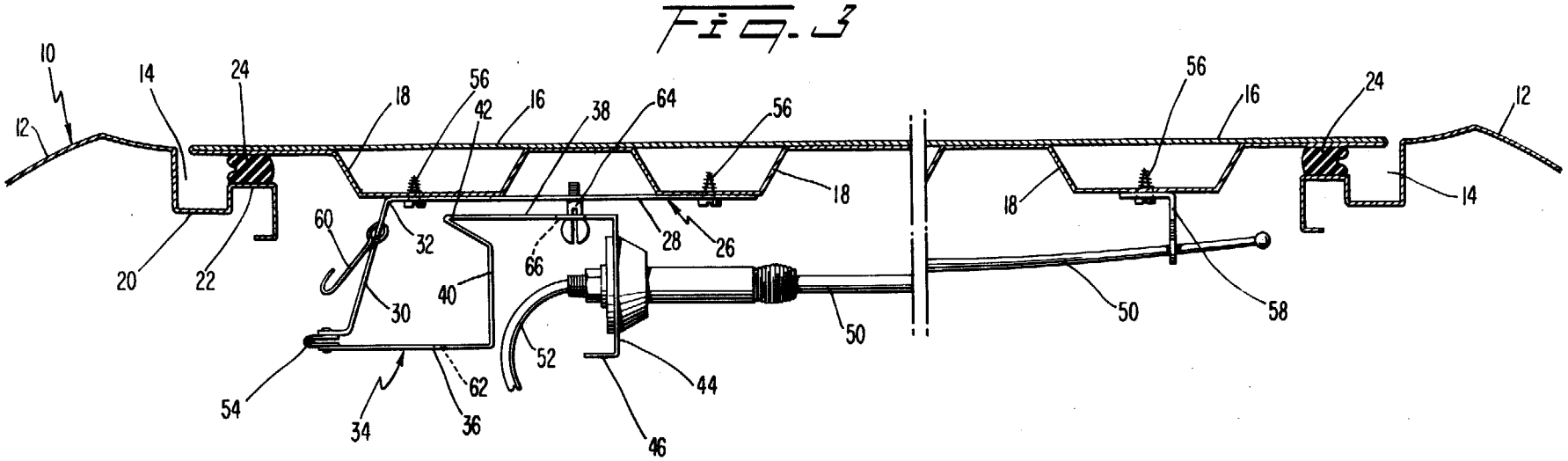
FIG. 3 is a sectional view similar to FIG. 2 but showing the antenna mounting bracket of the present invention in its concealed, storage position.
Figure 4:
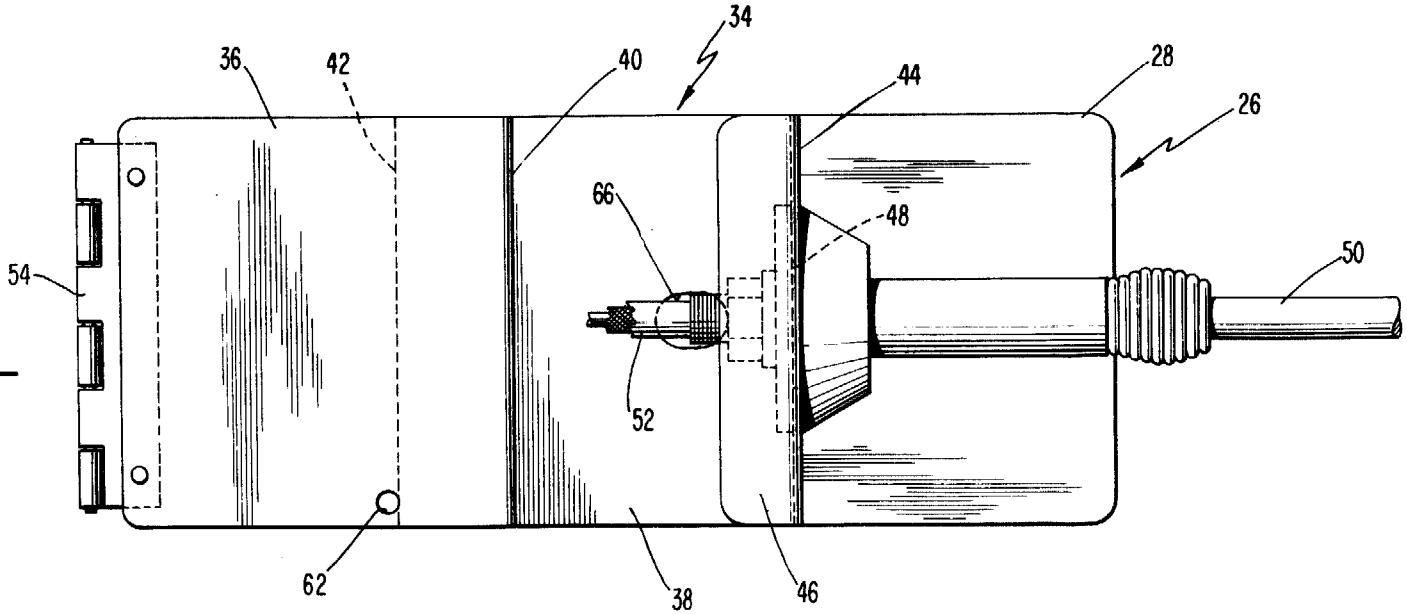
FIG. 4 is a bottom plan view of the antenna mounting bracket of FIG. 1.

It can be appreciated from FIG. 3 that the dimension of support portion 40 and V-shaped fold 42 is effeciently and effectively accommodated by the bracket according to the present invention in that arm 30 maintains hinge 54 in spaced relation to mounting plate 28. The distance between hinge 54 and plate 28 is at least as large as the dimension of support portion 40 and V-shaped fold 42 such that the antenna support 34 may be fully folded against the underside of the trunk lid 16.

Mounting plate 28 may be attached to support ribs 18 by any suitable means such as self-threading sheet metal screws 56; and a hook, clasp or other suitable coupling member 58 is attached to the underside of the trunk lid 16 adjacent the opposite side edge thereof for engaging and holding the distal end of antenna 50 when the same is stored.

Plate 28 of base member 26 may be mounted in any suitable position provided that a clear path is available for moving the antenna between its exposed and stored positions. Preferably, base 26 is mounted onto the underside of the lid 16 adjacent a side edge thereof with the axis of hinge 54 generally parallel to such edge. In this manner, when the antenna 50 is moved to its stored, concealed position, it will be laterally disposed across the lid.

A retention device in the form of a hook 60 is attached to arm 30 of base 26 and cooperates with a hole 62 in support portion 36 to maintain the antenna support 34 in its exposed or operative upright position during use. In this manner, whenever the trunk lid is open, the antenna support 34 will be held in place and will not inadvertently rotate about hinge 54.

Figure 2:
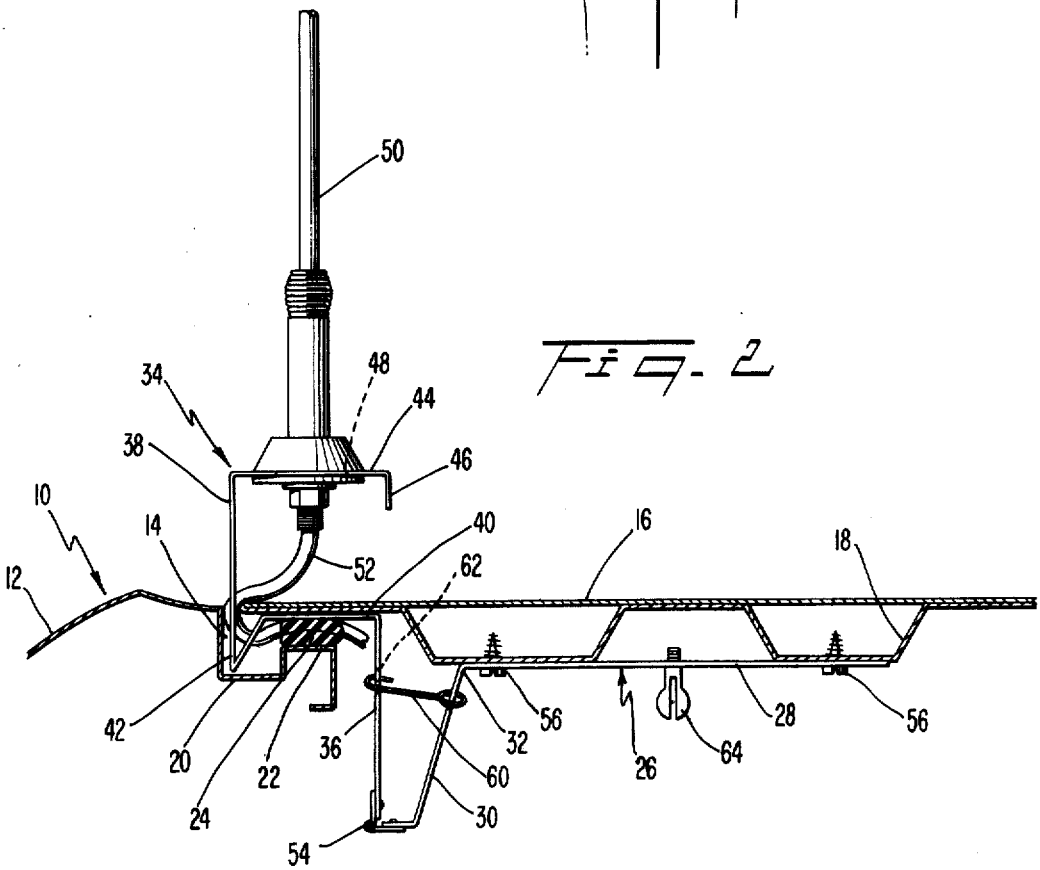
FIG. 2 is a sectional view of the antenna mounting bracket of FIG. 1 in its exposed or operative position.

A second retention device in the form of a split, spring pin 64 is attached to plate 28 and extends downwardly as shown in FIGS. 2 and 3. Pin 64 has an expanded tip for cooperation with a hole 66 in support portion 38 such that the antenna support 34 may be snapped into its stored position as shown in FIG. 3.

From the foregoing, it can be appreciated that the present invention provides for the positive mounting of an antenna on a vehicle for pivotal movement between an exposed, upright position outside the vehicle and a concealed, stored position within the vehicle. The antenna, when stored, is held in a convenient location which does not impede, hamper or otherwise limit the normal use of the vehicle. For example, when the antenna is mounted on the underside of a trunk lid, and is folded into its stored position, the trunk may be used in the normal manner without having to worry about interference from the antenna. The present invention thus allows for the quick and easy concealment of Citizens Band radio antennas by merely opening a closure member, such as a trunk lid, swinging the antenna from its upright position to its stored position, and closing the lid. The antenna and bracket are thereafter totally concealed and will not serve as a target for a potential thief.

A number of different retention means may be used together with the antenna mounting bracket according to the present invention in addition to the hook 60 and pin 64 shown in the accompanying drawing. For example, over-center springs may be associated with hinge 54 so as to bias the antenna support 34 into either of its two extreme positions. In addition, any number of suitable hooks, pins, springs, clasps and other assemblies may be used. Preferably, the present invention is made from sheet metal material, such as aluminum or steel, with any of various suitable finishes applied thereto.

Inasmuch as the present invention is subject to many variations, modifications and changes in detail, it is intended that all matter contained in the foregoing description or shown in the accompanying drawing shall be interpreted as illustrative and not in a limiting sense.

What is claimed is:

1. A bracket for mounting an antenna on a vehicle including a trunk lid for closing an opening providing access to the interior of the vehicle, comprising:

base means for fixed attachment to the underside of said trunk lid adjacent the opening;

antenna support means movably connected to said base means for folding between an exposed position extending through the vehicle opening to support an antenna for use outside the vehicle, and a storage position inside the vehicle to conceal a supported antenna when not in use;

an antenna assembly fixedly attached to the distal end of said antenna support means; and means for attachment to the underside of said trunk lid for engaging and holding said antenna when said antenna support means is in said storage position.

2. A bracket as recited in claim 1 wherein said base means is attached to said trunk lid adjacent a side edge thereof, and wherein said engaging and holding means is attached to said trunk lid adjacent the opposite edge thereof.

3. A bracket as recited in claim 1 further including retention means cooperating with said base means and said antenna support means to retain said antenna support means in said exposed position.

4. A bracket as recited in claim 1 wherein said antenna support means comprises first and second support portions laterally offset by a third support portion, the dimension of said third support portion being sufficient to traverse a gutter around the vehicle opening.

5. A bracket as recited in claim 4 further including a generally V-shaped fold in said third support portion to enable adjustment in the dimension thereof.

6. A bracket as recited in claim 4 further including a hinge pivotally interconnecting said base means and said antenna support means, said base means having an attachment plate and supporting said hinge at a distance from said attachment plate at least as large as said dimension of said third support portion of said antenna support means.

7. A bracket as recited in claim 1 including retention means cooperating with said base means and said antenna support means for holding said antenna support means in place when in either one of said exposed and storage positions.

* * * * *